United States Patent [19]

McIntyre

[11] 4,194,340

[45] Mar. 25, 1980

[54] APPARATUS FOR PACKAGING SHOELACES: ESPECIALLY OF THE ROUND TYPE

[75] Inventor: Newman McIntyre, Shelby, N.C.

[73] Assignee: McIntyre Packaging Company, Shelby, N.C.

[21] Appl. No.: 886,660

[22] Filed: Mar. 15, 1978

[51] Int. Cl.[2] ..... B65B 63/04; B65B 11/08

[52] U.S. Cl. ..... 53/119; 53/529; 53/586; 53/228

[58] Field of Search ..... 53/118, 119, 224, 228, 53/229, 232, 234, 529, 586, 230

[56] References Cited

U.S. PATENT DOCUMENTS

| | | | |
|---|---|---|---|
| 1,487,019 | 3/1924 | Lopez | 53/224 X |
| 1,545,513 | 7/1925 | Peters et al. | 53/234 |
| 1,674,026 | 6/1928 | Smith et al. | 53/586 |
| 1,927,708 | 9/1933 | Pieczentkowski | 53/586 |
| 2,894,363 | 7/1957 | Voogd | 53/228 |
| 3,024,580 | 3/1962 | McIntyre | 53/118 |
| 3,416,287 | 12/1968 | Hawkins et al. | 53/119 |
| 3,932,981 | 1/1976 | Fillman et al. | 53/529 |

FOREIGN PATENT DOCUMENTS

| | | | |
|---|---|---|---|
| 1016196 | 1/1966 | United Kingdom | 53/586 |

*Primary Examiner*—John Sipos

*Attorney, Agent, or Firm*—Bell, Seltzer, Park & Gibson

[57] ABSTRACT

Apparatus for packaging shoelaces in which flattened shoelace convolutions are moved away from a winding means for being received in an elongate lace confining channel of a first lace receiving unit which is then moved in a substantially vertical path into substantially aligned proximal relation to an elongate lace confining channel of a second lace receiving unit. The proximal portions of the units have elongate openings therein, communicating with the respective channels of the units, and through which the flattened shoelace convolutions are transferred from the channel of the first unit into the channel of the second unit. As this occurs a wrapper, previously positioned to extend across the elongate opening in the second lace receiving unit, is wrapped partially around the flattened convolutions. Means are provided for then moving at least one of the lace receiving units away from the other to provide a space therebetween into which folding means is movable for folding opposite ends of the wrapper into overlapping relation against the corresponding side of the flattened shoelace convolutions, whereupon the thus wrapped convolutions are ejected from the second lace receiving unit.

12 Claims, 13 Drawing Figures

RAISING & LOWERING MEANS FOR FIRST LACE RECEIVING UNIT

APPARATUS FOR PACKAGING SHOELACES: ESPECIALLY OF THE ROUND TYPE

BRIEF SUMMARY OF THE INVENTION

This invention relates to apparatus for packaging shoelaces, and more especially, to apparatus particularly adapted for packaging round shoelaces, i.e., shoelaces of substantially circular cross-sectional configuration.

Apparatus for automatically packaging shoelaces has been known for many years. By way of example, reference is made to the prior art U.S. patents of McIntyre; U.S. Pat. Nos. 3,024,580 and 3,906,701, dated Mar. 13, 1962 and Sept. 23, 1975, respectively, which illustrate apparatuses for winding shoelaces into circular convolutions, flattening the same into elongate flattened condition, and then positioning a wrapper around the flattened convolutions and folding opposite ends thereof into overlapping relation against one side of the convolutions.

Although the apparatuses of the aforementioned prior art patents have performed their intended functions quite well in most respects, some difficulties have been experienced in the packaging of so-called round shoelaces, essentially because of the inherent instability of adjacent convolutions of round shoelaces to the extent that such adjacent convolutions tend to "roll" and become displaced relative to one another during the various stages involved in the packaging process. Moreover, the relationship and construction of various components of the prior art packaging apparatuses have imposed problems in the replacement of some components by others to change over the apparatuses for the packaging of shoelaces of different size or type; e.g., length and/or cross-sectional area or configuration.

With the foregoing in mind, it is an object of this invention to provide an improved apparatus for packaging shoelaces wherein the component parts of the apparatus are so structurally related and operated as to provide improved control of the shoelaces throughout successive packaging stages so that round shoelaces, as well as flat shoelaces, are maintained in intact condition during packaging, thus contributing to the quality of the packaged product.

According to the preferred embodiment of the invention, the apparatus provides, in combination with means for winding shoelaces into convolutions and means for flattening the convolutions while moving them away from the winding means, a first lace receiving unit which defines a first elongate lace confining channel therein and which normally occupies a first position for receiving and confining therein the flattened shoelace convolutions from the winding means. A second lace receiving unit is space vertically away from the first lace receiving unit in its first position and defines a second elongate lace confining channel therein. Each of the lace receiving units also has an elongate opening in one side thereof communicating with the respective lace confining channel.

The apparatus is equipped with means for positioning a wrapper to extend across a medial portion of the opening in the second lace receiving unit, and means for moving the first lace receiving unit in a substantially vertical direction to a second position in proximal side-by-side relation to the second lace receiving unit with the elongate openings of the units in substantially aligned communicating relationship and so that the wrapper then is disposed between the first and second lace receiving units. Means are provided for transferring the flattened shoelace convolutions from the first lace confining channel, through the elongate openings into the second lace confining channel so that the wrapper is partially wrapped around the flattened convolutions, and means also are provided for then moving at least one of the lace receiving units away from the other lace receiving unit to provide therebetween a space for accommodating a folding operation. Folding means is then operable to move into the space between the lace receiving units for folding opposite ends of the wrapper into overlapping relation against the corresponding side of the shoelace convolutions, and means are provided for then ejecting the thus wrapped shoelace convolutions from the second lace receiving unit.

The invention further contemplates apparatus of the type described wherein the means for ejecting the wrapped shoelace convolutions from the second lace receiving unit may take the form of a plunger which normally occupies an extended position within the second channel and substantially closing the opening of the second lace receiving unit so that, during the transfer of the shoelace convolutions from the first lace receiving unit into the channel of the second lace receiving unit, the shoelace convolutions and the wrapper move against, and are thus supported by, the plunger as it is being moved inwardly in the second channel to a retracted position therein.

BRIEF DESCRIPTION OF DRAWINGS

Objects and advantages of the invention having been stated, other objects and advantages will appear as the description proceeds when taken in connection with the accompanying drawings, in which—

BRIEF SYNOPSIS OF THE APPARATUS

Referring more specifically to the drawings, a representative embodiment of the invention is illustrated in the accompanying drawings in combination with certain elements which may be generally of the type disclosed in the prior art U.S. patents of McIntyre; U.S. Pat. Nos. 3,024,580 and 3,906,701 mentioned earlier herein and to which reference is made for certain details not shown in the present drawings. It is to be understood that the structure referred to in such patents is relied upon only for exemplary purposes, since variations in such structure may be readily effected by a skilled mechanic without departing from the invention.

Figure 2:
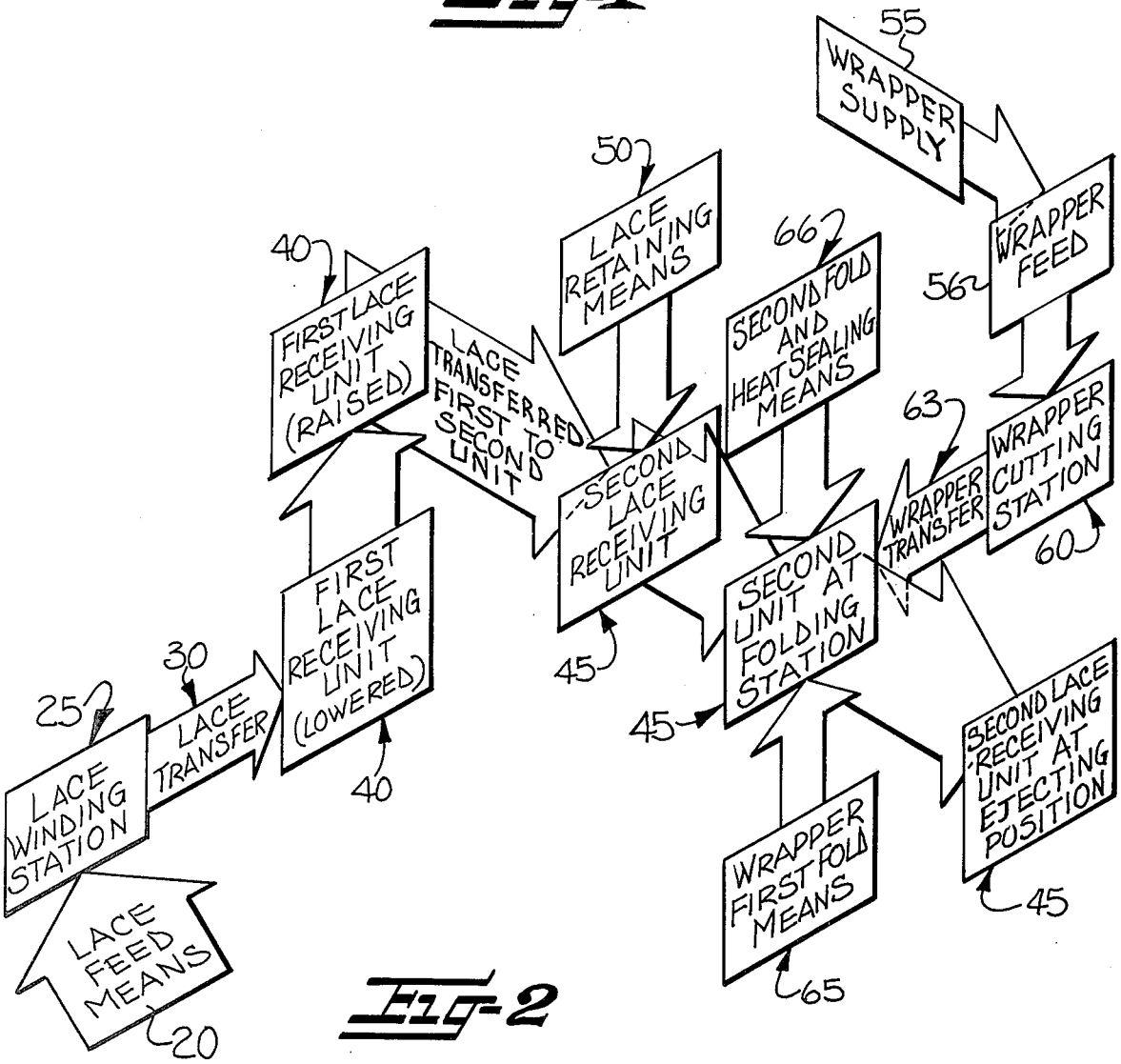
FIG. 2 is a block flow diagram illustrating a series of steps involved in the packaging of shoelaces according to this invention.
Figure 11:
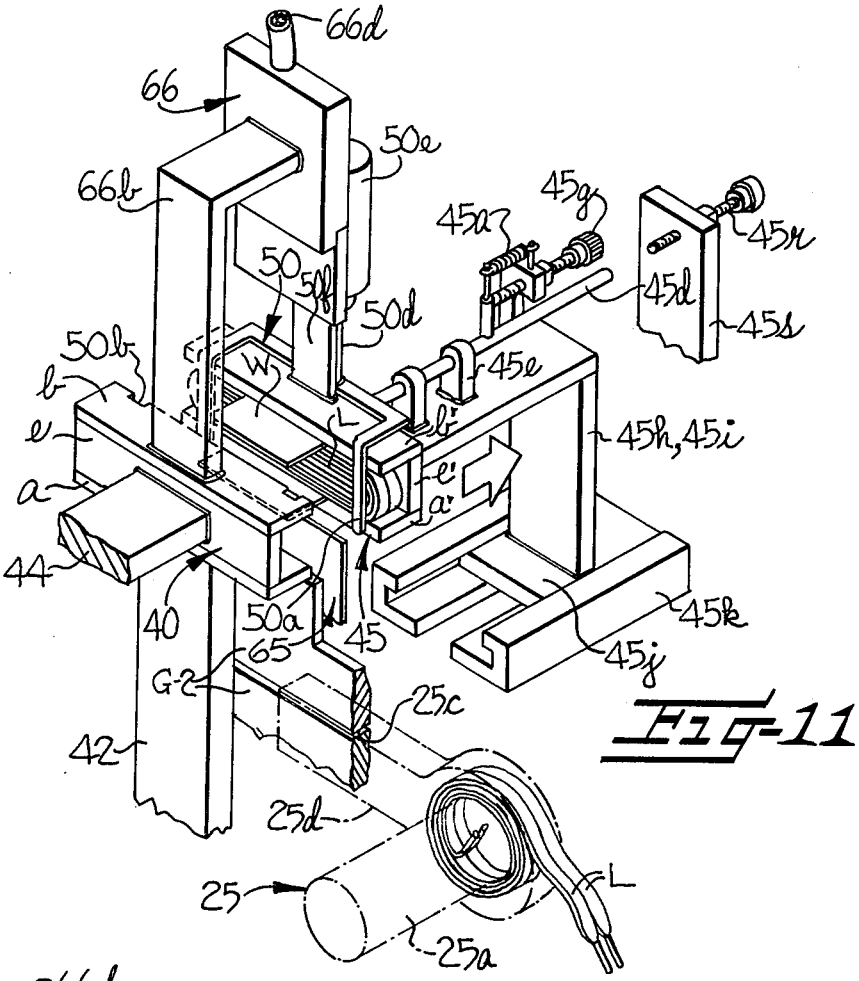

The shoelace packaging machine is shown diagrammatically in FIG. 2 as comprising lace feeding means 20, a lace winding station 25, and a lace transfer means 30, all of which may be of the type generally indicated at 20, 25 and 275, respectively, in FIG. 11 (in particular) of said U.S. Pat. No. 3,024,580. As disclosed in the latter patent, the shoelaces L, or successive pairs or sets of shoelaces, are received and wound into circular side-by-side convolutions at the winding station 25 (FIGS. 2 and 4), whereupon the lace transfer means 30 transfers the shoelaces to a first lace receiving unit 40 then occupying a first or lowered position. During the movement of the shoelace convolutions away from winding station 25, the convolutions are transformed into an elongate flattened condition for being received in this condition in an elongate lace confining channel of the first lace receiving unit 40, as will be later described.

Figure 9:
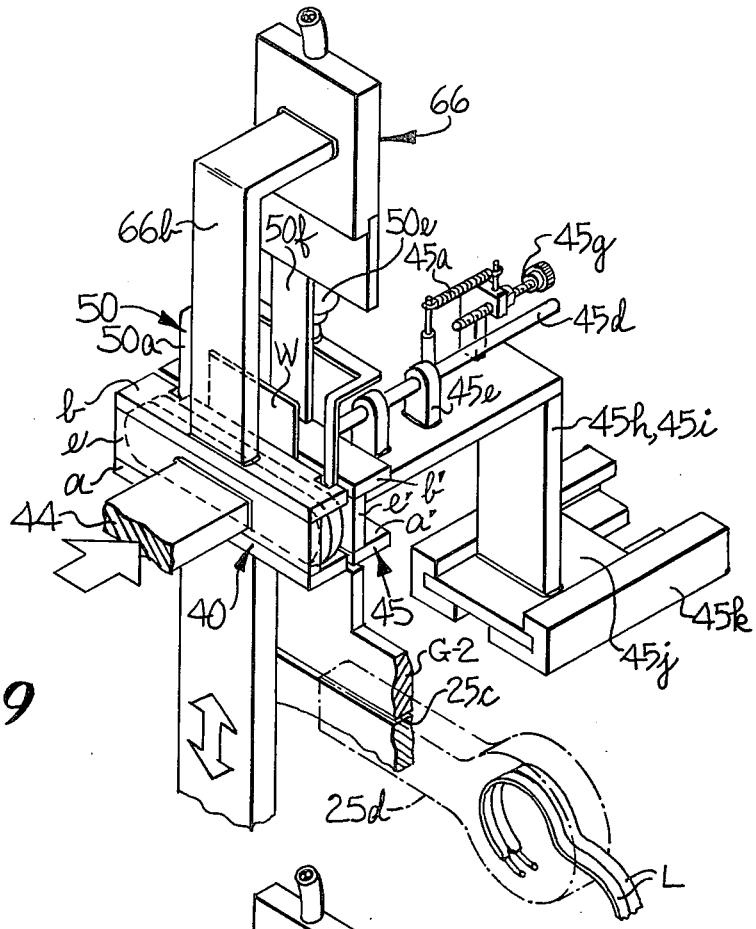
Figure 10:
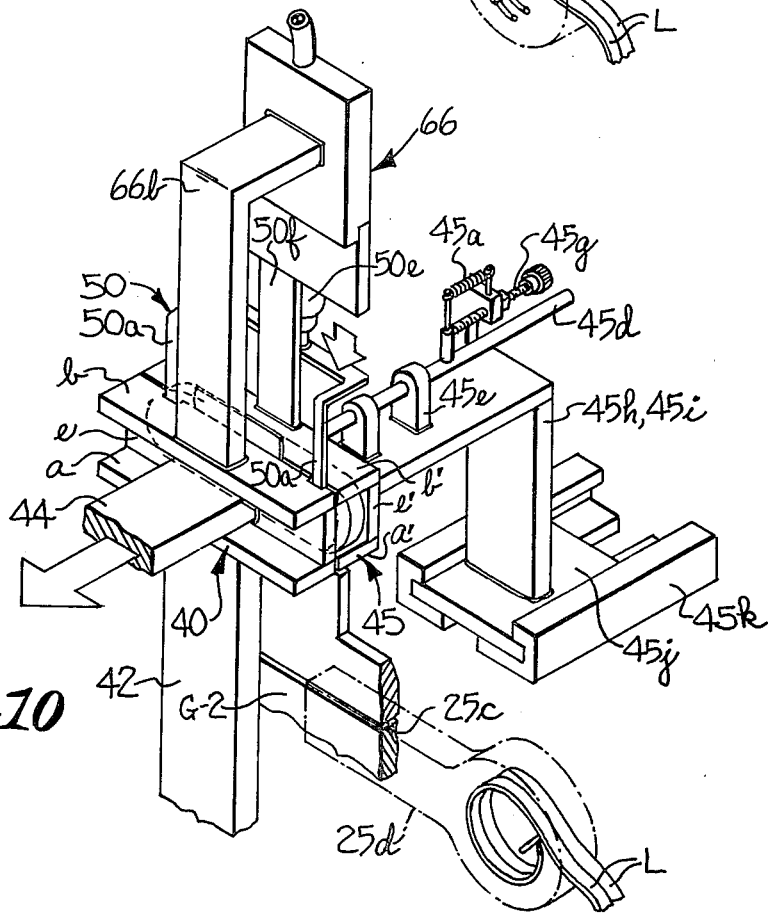

As further shown in FIG. 2, upon the shoelace convolutions being received in the first lace receiving unit 40, the unit 40 is moved vertically (upwardly in this instance) to a second or raised position in substantially aligned proximal relation to a second lace receiving unit 45 (see also FIGS. 9 and 10). As will be later described, the second lace receiving unit 45 also is provided with an elongate lace confining channel, and the proximal portions of the units 40, 45 have elongate openings therein which communicate with the respective channels of the first and second lace receiving units 40, 45.

Figure 12:
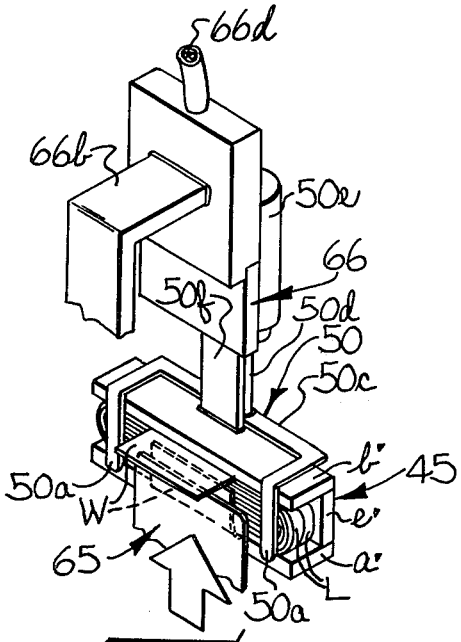
Figure 13:
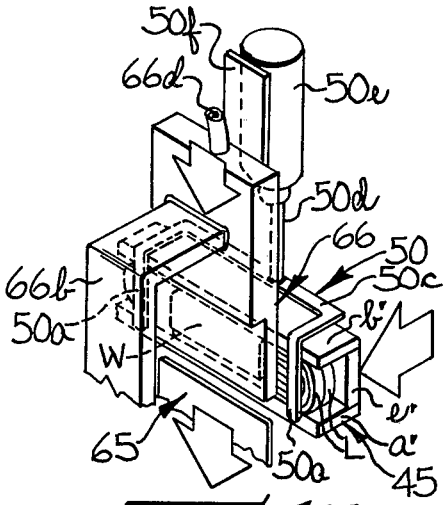

As indicated by the arrow so labeled in FIG. 2, following the substantially vertical movement of the first lace receiving unit 40 from its first or lowered position to its second or raised position, the flattened shoelace convolutions are transferred from the first lace receiving unit 40 into the channel of the second lace receiving unit 45, whereupon normally inactive lace retaining means 50 is moved to an active position between the first and second lace receiving units 40, 45 for forcibly engaging the shoelace convolutions adjacent opposite side edges of a wrapper previously positioned to extend across the elongate opening in the second lace receiving unit 45 (see FIGS. 11, 12 and 13). Thus, the lace retaining means 50 functions to aid in retaining the shoelace convolutions in the channel of the second lace receiving unit 45 during a subsequent folding operation.

Figure 1:
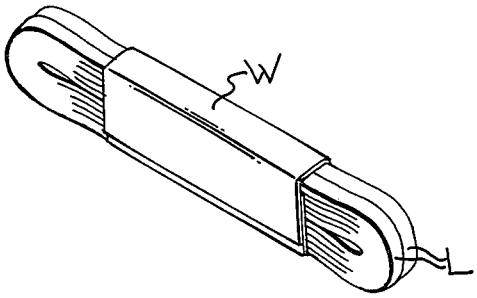
FIG. 1 is a perspective view of a typical pair of shoelaces as packaged utilizing the apparatus of this invention.
Figure 4:
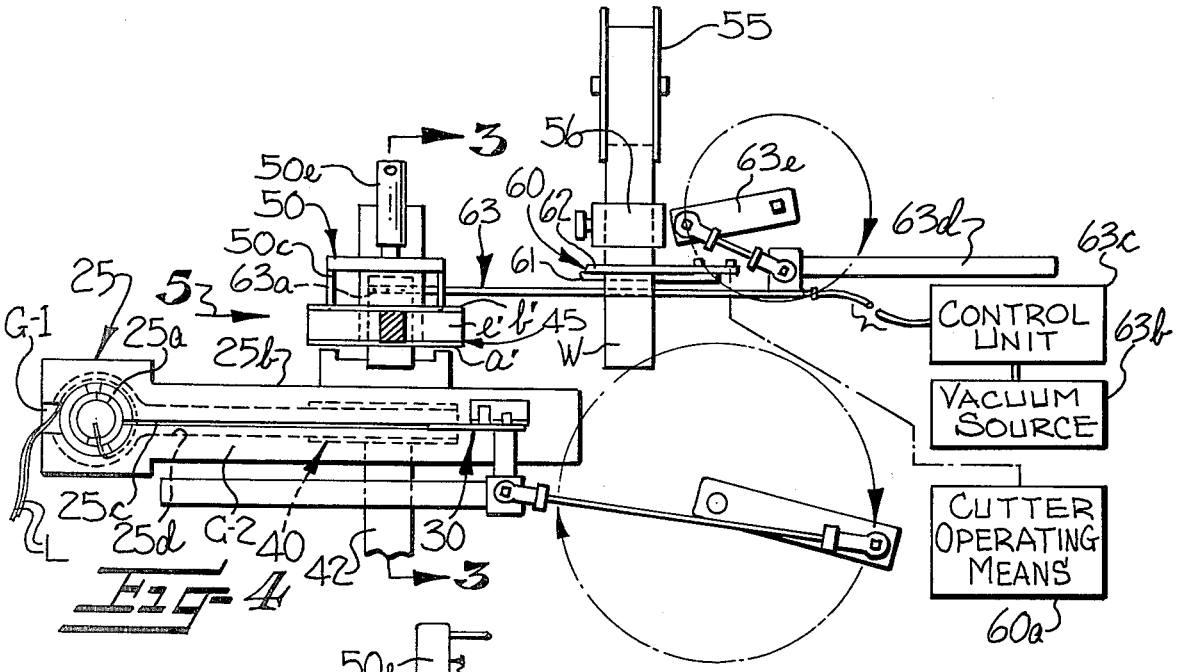
FIG. 4 is a schematic fragmentary elevation, on a reduced scale, taken looking rearwardly substantially along line 4—4 of FIG. 3.

Regarding the wrapper positioning means, it will be observed in the right-hand portion of the diagram of FIGS. 2 and 4 that wrapper material is fed from a source of supply 55, through wrapper feed means 56 and to a wrapper cutting station 60 where successive lengths of the wrapper material are cut therefrom to form successive labels or wrappers W (FIG. 1). As each successive wrapper is thus formed, it is transferred, by means to be later described, to a position in which it is suspended to extend across the elongate opening in the second lace receiving unit 45.

As the shoelace convolutions are being transferred from the first lace receiving unit 40 into the lace confining channel of the second lace receiving unit 45, it is thus apparent that the wrapper extending across the opening in the second lace receiving unit is wrapped partially around the flattened shoelace convolutions. The second lace receiving unit 45 is then moved forwardly away from the first lace receiving unit 40 and to a wrapper folding station or position (FIG. 2) to provide a space between lace receiving units 40, 45 into which first and second folding means 65, 66 are moved, successively, for folding opposite ends of the wrapper into overlapping relation against the corresponding side of the flattened shoelace convolutions, following which the thus wrapped convolutions are ejected from the second lace receiving unit 45.

DETAILED DESCRIPTION

Having briefly described essential elements of the apparatus and the operation thereof, a more detailed description will now be given. As best shown in FIG. 4, winding station 25 may take the form of an intermittently rotatable mandrel **25*a* to which each successive set or pair of shoelaces L is fed by the lace feeding means 20 (FIG. 2). The shoelaces are grasped by the mandrel 25*a* which is then rotated to wind the shoelaces thereon in the successive stages illustrated in FIGS. 8 through 11, so that the shoelaces then take the form of the circular convolutions best shown in FIG. 11, all of which may be substantially as described in said U.S. Pat. No. 3,024,580. Following the winding operation, mandrel 25*a* ceases rotating and is withdrawn rearwardly relative to a rear wall G-1 of a hollow guide means 25*b*, thus stripping the shoelace convolutions off of the mandrel 25*a***.

Before or at approximately the same time that mandrel **25*a* is withdrawn from the shoelace convolutions wound thereon, a finger 30*a* (FIG. 7) projecting rearwardly from the lace transfer means 30 is moved rearwardly so that its inner portion will be disposed within the circular convolutions of shoelaces L. The lace transfer means 30 then moves from left to right in FIG. 4 (from right to left in FIG. 7) along a longitudinal slot 25*c* formed in a front wall G-2 of the guide means 25*b* and which communicates with a shoelace confining passageway 25*d* in the hollow guide means 25*b*. Since the shoelace confining passageway 25*d* is of substantially lesser height than the effective diameter of mandrel 25*a*, it follows that the shoelace convolutions are flattened and thereby elongated as they are moved away from the winding means or mandrel 25*a* of winding station 25**.

The rear wall G-1 of the hollow guide means **25*b* is cut away to accommodate the first lace receiving unit 40 when it occupies its first or lowered position with an elongate lace confining channel thereof, to be presently described, substantially aligned with the lace confining passageway 25*d* of the hollow guide means 25*a*. The front wall G-2, on the other hand, extends past the first lace receiving unit when it occupies its first position so as to guidingly retain the shoelace convolutions in the channel of the first lace receiving unit 40 as its receives each successive set of flattened shoelace convolutions therein and also during subsequent vertical movement of the first lace receiving unit 40 (see FIGS. 7–10**).

Figure 3:
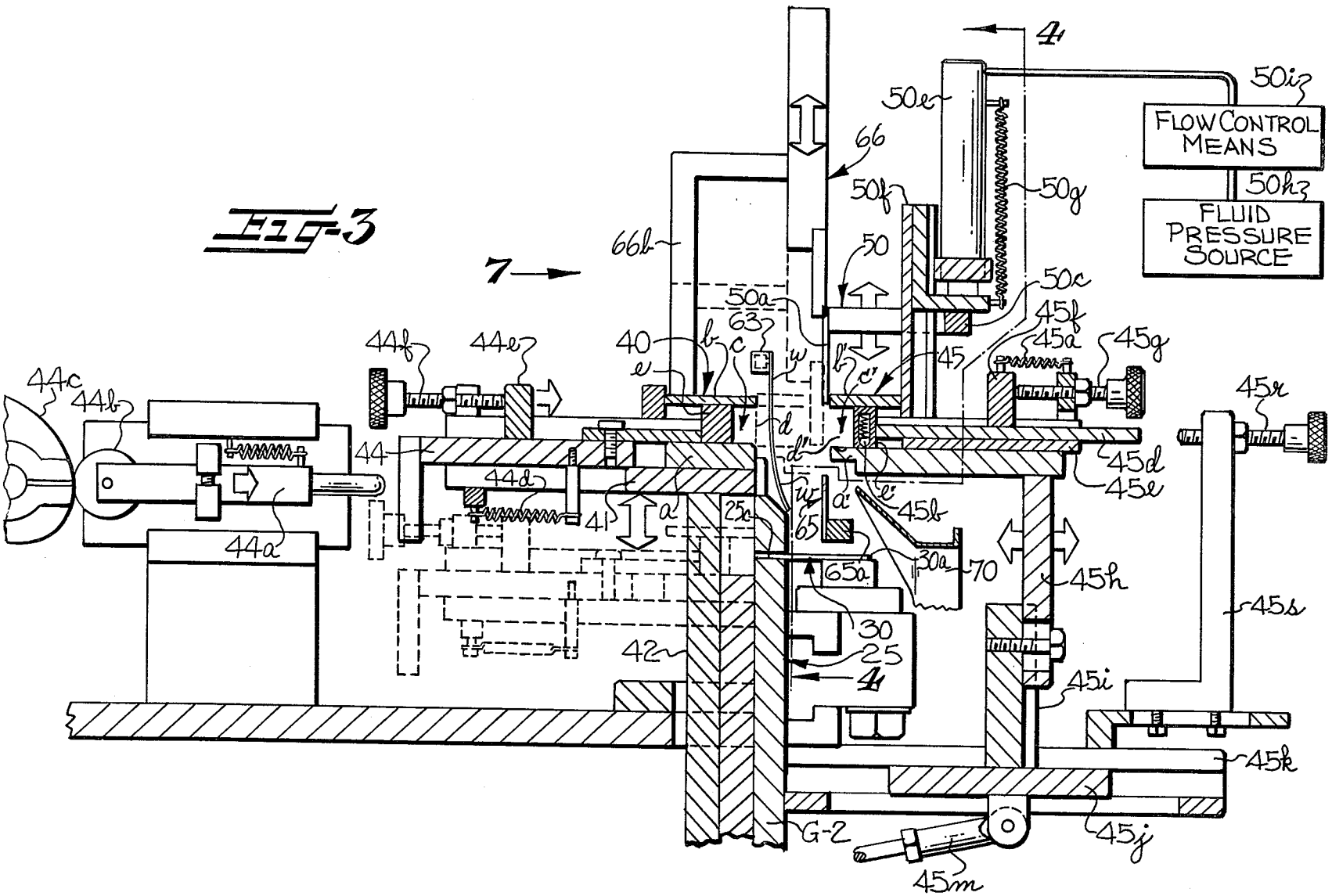
FIG. 3 is an enlarged vertical sectional view schematically illustrating certain essential components of the present apparatus and looking generally along line 3—3 of FIG. 4.

As best shown in FIG. 3, the first and second lace receiving units 40, 45 comprise respective pairs of vertically spaced elongate wall members a, b and a′, b′ which define respective first and second substantially parallel elongate lace confining channels c, c′ therebetween. The front edges of the lower and upper wall members a, b of the first lace receiving unit 40, and the rear edges of the lower and upper wall members a′, b′ of the second lace receiving unit 45 define respective first and second elongate openings d, d′ therebetween communicating with the respective first and second elongate channels c, c'.

First and second elongate plungers e, e' extend longitudinally within the respective channels c, c' and serve to define side walls for the channels and are transversely movable between retracted and extended positions within the respective first and second channels c, c'. It is to be noted that, when the plungers e, e' are retracted, they occupy respective primary positions spaced inwardly from the free edges of the corresponding wall members for accommodating flattened shoelace convolutions in the respective channels c, c'. In such primary positions, the plungers e, e' define respective elongate inner side walls extending longitudinally within the channels c, c'. On the other hand, when extended, the plungers e, e' occupy respective secondary positions substantially flush with, and closing the openings between, the free edges of the wall members a, b; a' b' of the respective lace receiving units 40, 45. It is apparent that the first plunger e occupies its respective primary position when the first lace receiving unit 40 is in its first or lowered position shown in broken lines in FIGS. 3 and 4.

The lower and upper wall members a, b of the first lace receiving unit 40 (FIG. 3) are suitably adjustably secured to a rearwardly extending guide block or base member 41 fixedly mounted on the upper end of a vertically movable post 42 which may be operated by any suitable means, such as a rotary cam, not shown, for raising and lowering the first lace receiving unit 40 at the desired intervals in a reciprocating manner. Thus, it can be appreciated that post 42 serves as means for moving the first lace receiving unit 40 between its first and second positions shown in respective broken and solid lines in FIG. 3. It can be seen in FIG. 8 that at about the time a set of flattened convolutions L is lodged in the first lace receiving unit 40, a succeeding set of convolutions L is being received by the winding station.

It should be noted that, when the first lace receiving unit 40 occupies its second or raised position, it is located in proximal side-by-side relation to the second lace receiving unit 45, as shown in FIGS. 9 and 10, with the elongate openings d, d' (FIG. 3) of the lace receiving units 40, 45 in substantially horizontally aligned communicating relationship and so that the wrapper W then is disposed between the first and second lace receiving units 40, 45. When the first lace receiving unit 40 reaches its second position upon termination of each upward movement thereof, the first elongate plunger e is moved from it primary position (FIG. 9) to its secondary position (FIG. 10) thereby serving as a convolutions transferring means for transferring the flattened shoelace convolutions from the first channel c, through the elongate openings d, d' and into the second channel c' and to thereby move the second plunger e' from its secondary position to its primary position whereby the wrapper W will be partially wrapped around the flattened shoelace convolutions thus transferred.

In order to move the first plunger e between its primary and secondary positions, an extension or arm 44 on plunger e extends rearwardly therefrom and is guided for substantially horizontal movement on the guide block 41 (FIG. 3), and the rear end of plunger extension 44 is adapted to be engaged by a thrust rod **44*a* suitably guided for forward and rearward movement on the frame of the apparatus. The rear end of thrust rod 44*a* is provided with a follower 44*b* which engages a driven rotary cam 44*c*. A spring 44*d* (FIG. 3) serves as suitable means for normally urging plunger e rearwardly so that an abutment 44*e* on plunger extension 44 bears against an adjustable abutment or adjustment screw 44*f* when plunger e occupies its desired primary or retracted position. Adjustment screw 44*f* may be threadedly mounted in a projecting portion of guide block 41**.

As heretofore indicated, the second plunger e' occupies its secondary position, substantially flush with the free edges of wall members a', b' (see FIGS. 7, 8 and 9), as the first lace receiving unit 40 moves upwardly to its second position. Accordingly, since the second plunger e' is biased forwardly toward its primary or withdrawn position, by a suitable spring **45*a* (FIG. 3), suitable means may be provided for releasably and yieldingly holding second plunger e' in its extended or secondary position at the desired intervals. Such releasable means may take the form of a yieldable detent 45*b*** positioned in plunger e' and adapted to seat in a suitable cavity provided in the upper surface of lower wall member a' whenever the second plunger e' occupies its secondary position.

As shown in FIG. 3, plunger e' also is provided with an extension arm **45*d* extending rearwardly therefrom and guided for forward and rearward substantially horizontal movement in a guide block 45*e* carried by the forward portion of the lower wall member a' forwardly of channel c'. Spring 45*a* normally biases second plunger e' forwardly so that an abutment 45*f* thereon normally engages an adjustable abutment or adjustment screw 45*g* threadedly penetrating an upwardly projecting portion of guide block 45*e***.

According to the invention, in addition to the novel construction of the lace receiving units 40, 45, the vertically movable arrangement of the first lace receiving unit 40 and the function and structural arrangements of the first and second plungers e, e', means are further provided for moving at least one of the lace receiving units away from the other lace receiving unit following the transfer of the shoelace convolutions from the first lace confining channel c into the second lace confining channel c' so as to provide a space therebetween for accommodating a folding operation. In this instance, it will be observed that the second lace receiving unit 45 is moved from the broken line position of FIG. 3 to the solid line position (see FIG. 11) following the transfer of the shoelace convolutions from the channel c into the channel c' so as to provide the desired space between the lace receiving units for accommodating the folding operation. To this end, again referring to FIG. 3, it will be observed that the forward portion of the lower wall a' of the second lace receiving unit 45 is suitably secured to the upper end of a post **45*h* which is adjustably secured to a guide post 45*i* whose lower end is suitably secured to a slide member 45*j***.

The posts **45*h*, 45*i* are longitudinally or vertically adjustable relative to each other to facilitate vertical adjustment of the second lace receiving unit 45 so that the lace confining channel c' thereof may be properly aligned with the lace confining channel c of the first lace receiving unit 40 occupying its second or raised position shown in solid lines in FIG. 3. The slide 45*j* is mounted for forward and rearward movement in a guide bar 45*k* suitably secured to and projecting forwardly from a fixed part of the frame of the apparatus. The forward end of a link 45*m* is connected to slide 45*j* and the rear end of link 45*m* is connected to a follower arm 45***n* (FIG. 5) having a follower 45*p* thereon normally urged into engagement with the periphery of an irregular cam 145 (FIGS. 5 and 6) by a suitable spring 45*q*.

The rotary cam 145 is shaped so that the second lace receiving unit 45 will be moved to at least three different predetermined positions during each shoelace packaging cycle of the apparatus; namely, a first or rearward position shown in broken lines in FIG. 3, a second or intermediate position shown in solid lines in FIG. 3, and a forward or third position, not shown, in which the wrapped shoelace convolutions are removed from the second lace receiving unit 45 in a manner to be later described. It is to be noted that, when the second lace receiving unit 45 occupies its first or rearward position, the free edges of the lower and upper wall members a', b' are positioned in substantially vertical alignment with the rear surface of the front wall G-2 of hollow guide means 25*d*, and thus are positioned closely adjacent the upward path of travel of the free edges of the lower and upper wall members a, b of the first lace receiving unit 40 as it is being moved from its first position to its second position so that the first lace receiving unit 40 is thus moved into proximal side-by-side relation to the second lace receiving unit, in the manner heretofore described, as the first lace receiving unit reaches its second position.

Following the transfer of the flattened shoelace convolutions from the first lace receiving unit 40 into the second lace receiving unit 45, the spring 45*a*, abutment 45*f* and stop screw 45*g* (FIG. 3) maintain the second plunger e' in the desired primary or retracted position for accommodating the flattened shoelace convolutions and the wrapper W in the corresponding elongate lace confining channel c'. Rotary cam 145 then causes the second lace receiving unit 45 to move forwardly away from the first lace receiving unit 40 to the intermediate or second position (see FIG. 11) so as to provide a space between the lace receiving units for accommodating the folding operation in a manner to be later described. Thus, this second position of the second lace receiving unit 45 also may be termed as a "folding station" for the second lace receiving unit 45 (see FIG. 2).

Thereafter, in order to remove the thus wrapped shoelace convolutions from the lace confining channel c, relative movement is effected between the lace receiving unit 45 and the plunger e' such as to move the plunger e' to the secondary or extended position. Accordingly during the movement of the second lace receiving unit 45 to the afore-mentioned third position (which also may be termed as a "lace ejecting position" as seen in FIG. 2), the forward end of guide bar 45*d* of plunger e' moves into engagement with an adjustable abutment or adjustment screw 45*r* threadedly penetrating an upstanding member or post 45*s* suitably secured on the guide bar 45*k* heretofore described.

Figure 7:
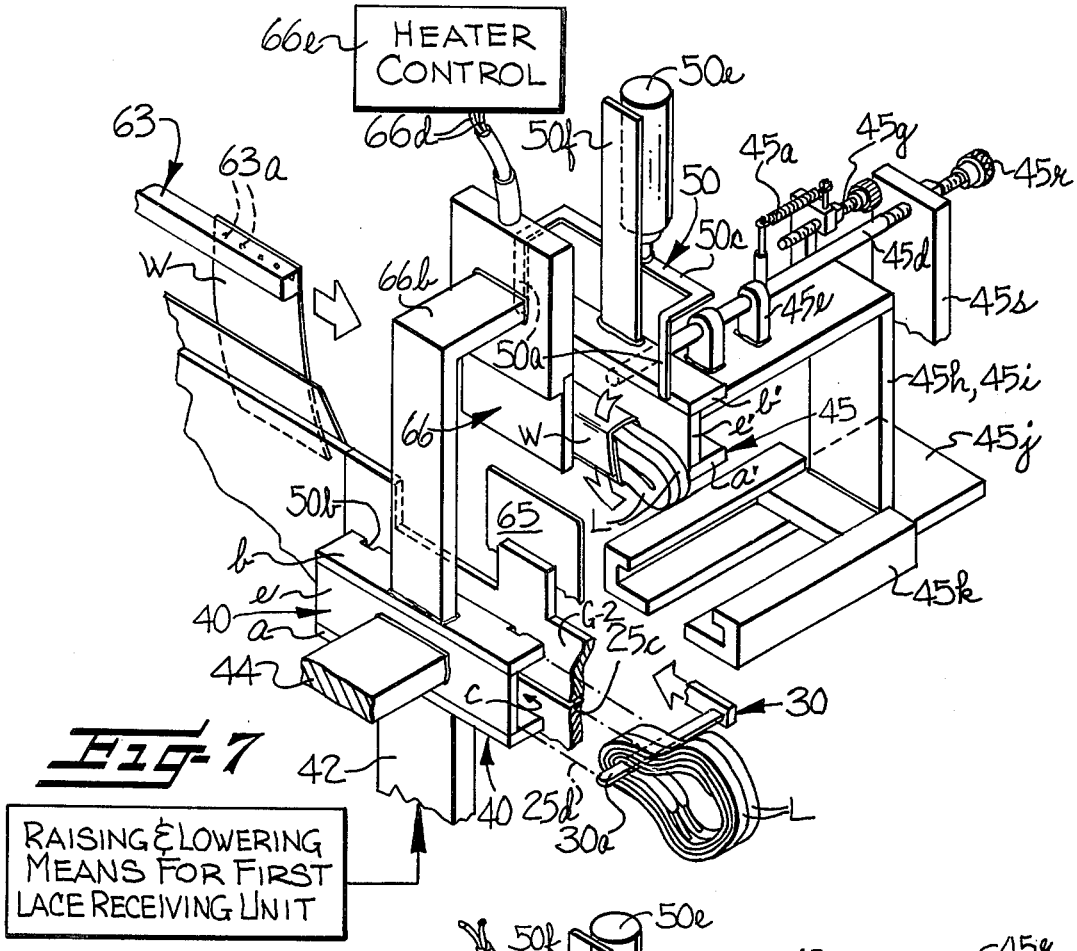
FIGS. 7 through 13 are schematic, fragmentary perspective views looking forwardly generally in the direction of the arrow 7 of FIG. 3 and illustrating successive stages in the operation of the apparatus of this invention.

Adjustment screw 45*r* is so positioned that, during the forward movement of second lace receiving unit 45 to its forwardmost or third position, after the forward end of the guide bar 45*d* engages the abutment or adjustment screw 45*r*, the second lace receiving unit 45 moves forwardly a predetermined distance relative to the guide bar 45*d* and the second plunger e' so that the second plunger occupies its secondary or extended position, as shown in FIG. 7, with the detent 45*b* therein (FIG. 3) engaging the recess or cavity provided in the upper surface of the wall member a', thus preparing the second lace receiving unit 45 for its next succeeding cycle of operation. Thus, it can be seen that second plunger e' cooperating with adjustment screw 45*r* collectively serve as means for removing the wrapped shoelace convolutions from the second lace confining channel c'. Thereafter, the cam 145 of FIG. 5 then causes the second lace receiving unit 45 to return to its first position shown in broken lines in FIG. 3 and in solid lines in FIGS. 9 and 10.

When the second lace receiving unit 45 is moved from its intermediate or second position to its third position in the manner last described, it should be noted that the movement of the second plunger e' to its secondary positon will push the wrapped shoelace convolutions out of the channel c' (See FIG. 7), and the wrapped shoelace convolutions thus ejected may fall into a suitable discharge chute 70 (FIG. 3).

As indicated earlier herein with reference to FIG. 2, wrapper material is fed from a source 55 to a cutting station 60 where it is cut into successive individual wrappers W and then delivered to the second lace receiving unit 45. As shown in FIG. 4, the source of wrapper material 55 may take the form of a reel or roll, suitably supported in offset relation from lace receiving units 40, 45, and from which the wrapper material is intermittently withdrawn by a suitable feed roll means 56 which feeds the wrapper material to the wrapper cutting station 60. The wrapper cutting station 60 may take the form of a fixed blade 61 and a movable blade 62 constituting cutting means controlled by suitable cutter operating means 60*a* for successively cutting predetermined lengths from the wrapper material to form successive labels or wrappers W therefrom. The wrapper material is suspended from the feed roll means 56 so that it extends downwardly from the cutting blades 61, 62 past and immediately adjacent an elongate substantially horizontally extending wrapper supporting transfer arm 63.

As preferred, transfer arm 63 is of hollow or tubular construction and is provided with wrapper gripping means which may take the form of a row of small perforations or suction ports 63*a* (FIG. 4) adjacent the free end of arm 63 and which are positioned immediately adjacent the wrapper material being cut and to which suction is applied so that the upper portion of each successive wrapper W formed by the cutting station 60 is releasably suspended from the free end portion of the wrapper transfer arm 63. The suction may be applied to the interior of the wrapper transfer arm 63 by a suitable vacuum source or suction means 63*b* coupled to a suitable fluid control device 63*c*.

Figure 8:
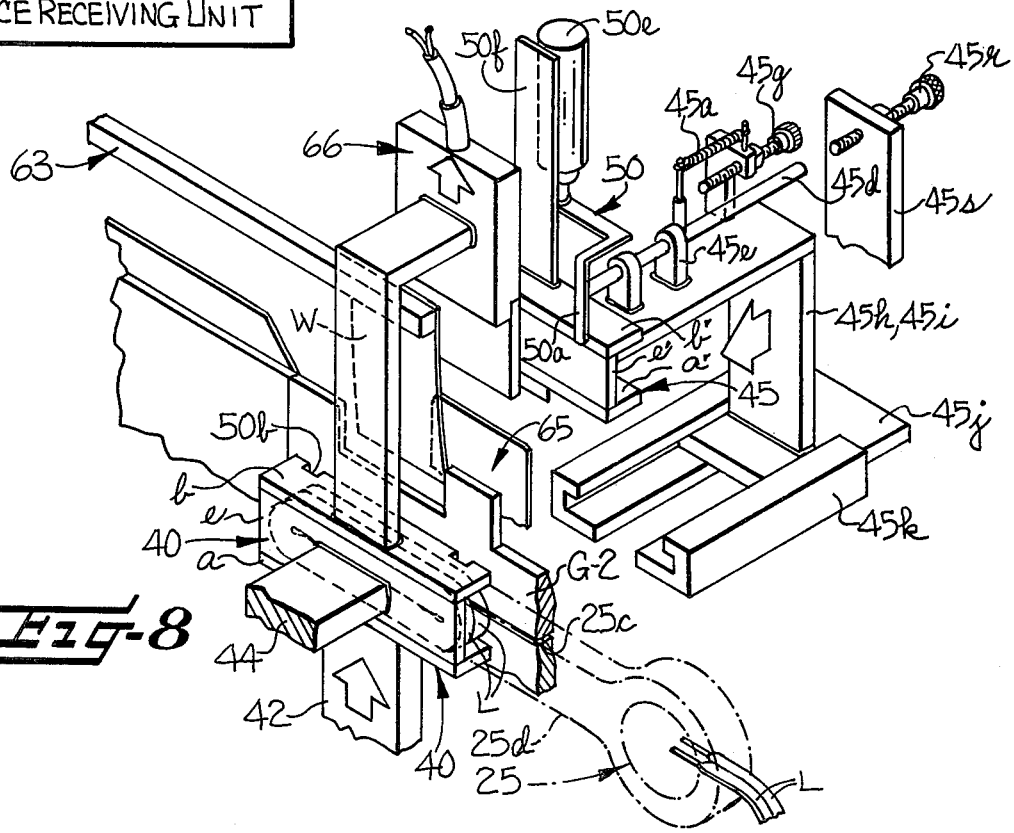

Following the cutting of each successive wrapper W from the wrapper material by the cutter blades 61, 62, the wrapper then suspendingly supported by the wrapper transfer arm 63 is then transported and thereby transferred to a position rearwardly of the second lace receiving unit 45 occupying its first position heretofore described (see FIGS. 7 and 8). In so doing, transfer arm 63 then suspendingly supports the wrapper so that it extends across a medial portion of the opening d' communicating with the second channel c' as best shown in FIGS. 3 and 4. The wrapper transfer arm 63 may be guided on a suitable stationary guide member 63*d* (FIG. 4) suitably supported by the frame of the apparatus. The wrapper transfer arm 63 may be reciprocated once during each cycle in the operation of the apparatus by suitable connections with a rotary crank 63*e* (FIG. 4). The vacuum or suction control device 63*c* serves to momentarily cut off the suction in the hollow wrapper transfer arm 63 at about the same time that the plunger e (FIG. 3) of the first lace receiving unit 40 is operated for transferring the corresponding shoelace convolutions from the first elongate lace confining channel c into the second lace confining channel c' in the manner heretofore described. Thus, the suspended wrapper W is released to be partially wrapped around the corresponding shoelace convolutions as they are pushed into the second channel c' by the plunger e. Thereupon, the wrapper transfer arm 63 is returned to its wrapper receiving position preparatory to a succeeding cycle in the operation thereof.

The lace retaining means 50 (FIG. 2) serves to forcibly engage the ends of the shoelace convolutions adjacent opposite side edges of the wrapper W (see FIGS. 11–13) following the transfer of the shoelace convolutions from the first channel c into the second channel c' and before the second lace receiving unit 45 is moved away from the first lace receiving unit, to insure that the shoelace convolutions remain intact during such movement of the second lace receiving unit and during the subsequent folding operation. Accordingly, it will be observed in FIGS. 7 through 13 that the lace retaining means 50 comprises a pair of normally inactive spaced apart retaining elements or fingers 50*a*, normally spaced above the lace confining channel c', and which are spaced sufficiently apart from each other so that they may straddle the opposite ends of the wrapper W projecting from the second lace confining channel c' when the corresponding shoelace convolutions have been transferred from the first channel c into the second channel c'. At least the upper wall member b of the first lace receiving unit 40 is provided with a pair of notches or recesses 50*b* in the free edge thereof to accommodate the convolution retaining elements 50*a* when they are moved downwardly between the first and second lace receiving units 40, 45, from the inactive position of FIGS. 3 and 7–11 to the active position of FIGS. 5, 12 and 13, for forcibly engaging the convolutions adjacent opposite side edges of the wrapper to aid in retaining the convolutions last transferred in the second elongate lace confining channel c during the subsequent wrapper and folding operation.

Any suitable means may be provided for effecting the desired operation of the shoelace retaining elements 50*a*. As a representative embodiment of such means, it will be observed in FIGS. 3, 4, 5 and 7–13 that the spaced shoelace retaining elements 50*a* are secured to or formed integral with a bracket 50*c* suitably secured to the lower end of a piston rod 50*d* vertically movable in a cylinder 50*e*. Cylinder 50*e* is mounted on an upstanding bracket 50*f* whose lower portion is suitably secured to the second lace receiving unit 45.

The bracket 50*c*, to which the upper portions of the shoelace retaining elements 50*a* are attached, is normally urged upwardly to the inactive position of FIGS. 3, 7, 8, 9 and 10 by a suitable spring 50*g*. A suitable fluid pressure source 50*h* is connected, via a suitable flow control means 50*i*, to the cylinder 50*e*. Thus, it is apparent that the admission of fluid pressure into cylinder 50*e* will impart downward movement to piston rod 50*d* and bracket 50*c* to lower the convolution retaining elements 50*a* into the active position heretofore described. It is also apparent tht the retaining elements 50*a* will subsequently move with the second lace receiving unit 45 as it is moved away from the first lace receiving unit 40 in the manner heretofore described to provide a space therebetween to accommodate a folding operation. In this regard, the first and second folding means 65, 66 heretofore described with respect to FIG. 2 are shown in FIGS. 3, 5 and 7 through 13 in the form of vertically movable folder plates respectively positioned below and above the level of second lace receiving unit 45, as shown in FIGS. 3, 9, 10 and 11 during the transfer of the shoelace convolutions from the first lace receiving unit 40 in its second position into the second lace receiving unit 45, and also during the movement of the space retaining elements 50*a* downwardly from their normally inactive position to the active position in which the retaining elements 50*a* are in engagement with the shoelace convolutions in the second elongate lace confining channel c'.

The first and second vertically movable folder plates 65, 66 occupy their respective inactive positions below and above the level of the second lace receiving unit 45 until the second lace receiving unit 45 has been moved to its second or intermediate position as shown in solid lines in FIG. 3 (see also FIGS. 9, 10 and 11). Means are provided for then successively moving the first or lower folder plate 65 upwardly and the upper folder plate 66 downwardly between the spaced retaining elements 50*a* to successively fold the lower and upper projecting ends of the wrapper against the rear surface of the shoelace convolutions then present in the second lace confining channel c' as shown in the successive stages of FIGS. 12 and 13.

In order to effect the desired movement to the lower folder plate 65, its lower portion is mounted on a vertically reciprocable support member 65*a* (FIG. 3) connected to suitable means, not shown, for moving the first folder plate 65 upwardly in the space between the lace receiving units 40, 45 and then moving the same downwardly to its inactive position illustrated in FIGS. 3, 8 and 11. The upper or second movable folder plate 66 is mounted on the upper portion of an inverted substantially L-shaped standard 66*b* whose vertical leg has its lower end suitably secured to the first lace receiving unit 40 so as to move upwardly and downwardly with the first lace receiving unit 40.

It will be noted that, following each movement of the second lace receiving unit 45 from its first position to its second position and the subsequent movement of the retaining elements 50*a* into operative position, the post 42 (FIG. 3) moves downwardly to lower the first lace receiving unit 40 therewith and thereby return the same to its first position preparatory to receiving a subsequent set of shoelace convolutions from the lace winding station 25. As the first lace receiving unit 40 returns to its lowered or first position shown in broken lines in FIGS. 3 and 4 and in solid lines in FIG. 7 and 8, it is apparent that the upper or second folder plate 66 is also moved downwardly therewith to thus fold the upper projecting end of the wrapper W downwardly against the corresponding face of the shoelace convolutions then present in the second lace confining channel c'. By the same token, it is apparent that subsequent upward movement of the first lace receiving unit to its second position during a subsequent cycle in the operation of the apparatus causes the second or upper movable folder plate 66 to return to its normal or inactive position.

It is preferred that the material of which the successive wrappers are formed is heat-fusible or heat-sealable so that opposite ends of the wrapper projecting from the second lace confirming channel c' may be heat-sealed together when they are folded in overlapping relationship in the manner heretofore described. The wrapper material may be a plastic material such as polyethylene or the wrapper material may have heat-sensitive adhesive applied thereto to heat-seal the overlapping ends of the wrapper together. Accordingly, the upper or second folder plate 66 may contain a suitable resistance heater therein, not shown, to which electrical current may be directed through conductors **66*d* (FIG. 7) connected to the upper portion of the upper folder plate 66. The flow of current to the conductors 66*d* may be controlled by a suitable heater control shown schematically at 66*e*** in FIG. 7.

Figure 5:
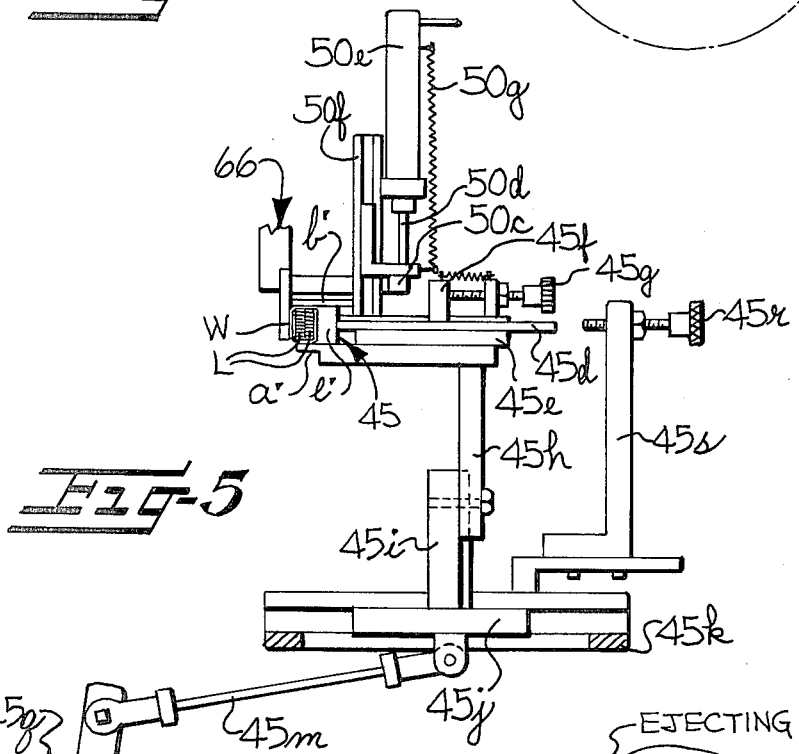
FIG. 5 is a fragmentary schematic view looking generally in the direction of the arrow 5 of FIG. 4 and illustrating suitable means for shifting stepwise one of the lace receiving units forwardly and rearwardly.
Figure 6:
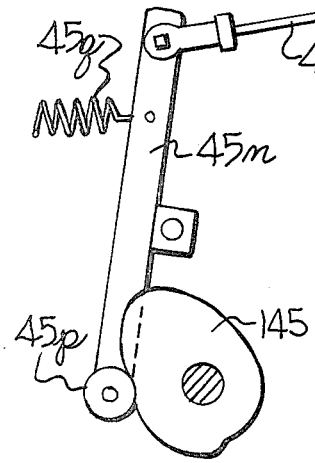
FIG. 6 is an enlarged elevation of the rotary cam 145 shown in the lower left-hand portion of FIG. 5.
Figure 6:
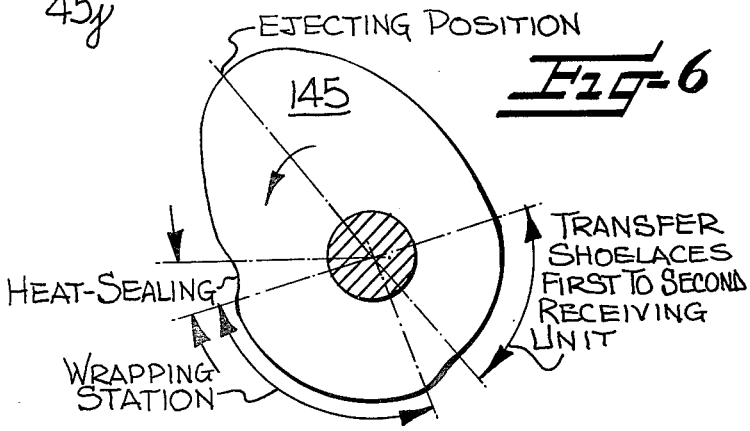

In order to insure that the heat-sealable material is not activated or overheated before the actual folding of the corresponding end of the wrapper has been fully effected, the upper or second folder plate 66 is so positioned with respect to the second lace receiving unit 45 as the upper folder plate 66 moves into the space between the lace receiving units 40, 45 that it will not tightly press against the wrapper and tightly press the corresponding end of the wrapper against the shoelace convolutions in the channel c'. Thus, in order to insure that the overlapping ends of the wrapper are firmly heat-sealed together, after the upper folder plate 66 has moved downwardly and folded the corresponding end portion of the wrapper against the shoelace convolutions in the channel c', the cam 145 of FIGS. 5 and 6 is so shaped that a quick, short rearward stroke is imparted to the second lace receiving unit 45 and its plunger e' to thereby press the shoelace convolutions outwardly against the overlapping portions of the ends of the wrapper, to in turn, press such overlapping ends of the wrapper against the heated second folder plate 66 to complete the packaging operation. Thereafter, as heretofore indicated, a further forward motion is imparted to the second lace receiving unit so that the arm **45*d* on the second plunger e' engages the screw 45*r* and the unit 45** then moves forwardly relative to plunger e', thus causing the plunger e' to eject the wrapped shoelace convolutions from the channel c' through the opening d'.

The operation of the apparatus has been described in connection with the detailed description of the structural components of the apparatus. Therefore, a repetition of the description of such operation is deemed unnecessary, with the exception of certain features which will now be reviewed.

At the outset, it is to be noted that the shoelace convolutions are substantially closely confined throughout the packaging of each successive shoelace or pair of shoelaces, from the time that each set of convolutions is wound and flattened until it is wrapped with a corresponding wrapper W for being discharged from the apparatus. It is apparent that such confinement of the shoelace convolutions being packaged aids in preventing undesirable "rolling" or displacement of adjacent runs of the convolutions relative to each other, thus contributing to efficient operation of the apparatus as well as contributing to the quality of the packages being produced.

In this regard, it can be appreciated that the shoelace convolutions are closely confined in the passageway **25*d* as they are being flattened and elongated while beig moved away from the winding station 25 by the lace transfer means 30 and into the first lace confining channel c defined between the lower and upper wall members a, b of the first lace receiving unit 40 then occupying its lowered or first position. As preferred, the distance between the proximal surfaces of the lower and upper wall members a, b is substantially the same as the distance between the lower and upper wall surfaces of the passageway 25*d*, and the distance between the front wall G-2 of the winding station 25 and the adjacent or front surface of the plunger e in its retracted or primary position also is substantially the same as the distance between the rear and front walls G-1, G-2 between which the passageway 25*d*** is defined. Since there may be some variation in the effective length of successive sets of elongate flattened shoelace convolutions measured from one looped end thereof to the other looped end thereof, it may be preferred that opposite ends of the lace receiving units are left open.

To insure that the shoelace convolutions are properly confined in the first lace confining channel c throughout the upward movement thereof from the first position to the second position of the first lace receiving unit, it is to be noted that the portion of the front wall G-2 of the hollow guide means **25*b* adjacent the path of travel of the first lace receiving unit 40 terminates at its upper edge closely adjacent the lower wall member a' of the second lace receiving unit 45 (see FIGS. 3, 9 and 10). Thus, as the first lace receiving unit 40 moves upwardly, the shoelace convolutions in the confining channel c thereof may slide against the rear surface of the front wall G-2 and directly therefrom into engagement with the rear edge of the bottom wall member a' of the second lace receiving unit 45**, and then the outer or front surface of the convolutions will slide against the rear surface or wall of the plunger e' which then is occupying its extended or secondary position.

The confinement, and thus the control of, the shoelace convolutions are further assured during the transfer of the shoelace convolutions from the first lace confining channel c into the second lace confining channel c', since the first plunger e may push the shoelace convolutions against the second plunger e' until its abutment **45*f* (FIG. 3) engages the adjustable abutment 45*g*, whereupon the shoelace convolutions are then quite closely confined between the lower and upper wall members a', b' of the second lace receiving unit 45, and the convolutions are also bearing against the rear or outer surface of the second plunger e'. It is apparent that the wall members a', b' of the second lace receiving unit 45** are spaced apart from each other substantially the same distance as are the wall members a, b of the first lace receiving unit.

As heretofore described, before the second lace receiving unit 45 moves away from the first lace receiving unit 40 preparatory to the folding operation heretofore described, the lace retaining fingers **50*a* move downwardly between the lace receiving units 40, 45 to forcibly engage the corresponding end surface of the shoelace convolutions then in the second lace confining channel c'. Thus, it can be appreciated that the shoelace convolutions are firmly retained in intact condition within the second lace confining channel e' during the operation of the folding means 50, with the retaining elements 50*a*** not being withdrawn from the shoelace convolutions until after the corresponding folding operation has been effected, so as to permit the shoelace convolutions with the wrapper W thereon to then be ejected from the second lace confining channel and thereby removed from the apparatus.

From the foregoing description, it can be seen that the lace winding station 25 and the lace receiving units 40, 45 are each constructed as modular units, as preferred, so they may be readily interchangeable with similar modular units for accommodating the packaging of shoelaces of a different size or type; e.g., length and/or cross-sectional area or configuration. Since the interchanging of such modular units and corresponding adjustments of certain components to effect a change-over of the apparatus are within the skill of a trained mechanic, a further, more detailed, disclosure of such a change-over of the apparatus will not be given.

In the drawings and specification, there has been set forth a preferred embodiment of the invention, and although specific terms are employed, they are used in a generic and descriptive sense only and not for purposes of limitation.

That which is claimed is:

1. In an apparatus for packaging shoelaces having winding means for winding shoelaces into circular convolutions and means for flattening and thereby elongating the convolutions while moving the same away from the winding means; the combination therewith of a first lace receiving unit defining a first elongate lace confining channel therein and normally occupying a first position for receiving and confining therein the flattened shoelace convolutions from the winding means, and said first lace receiving unit having an elongate opening in one side thereof communicating with said first channel, a second lace receiving unit spaced vertically away from said first lace receiving unit in its first position and defining a second elongate lace confining channel therein, said second lace receiving unit also having an elongate opening in one side thereof communicating with said second channel, means for positioning a wrapper to extend across a medial portion of the opening in said second lace receiving unit, reciprocating means for moving said first lace receiving unit in a substantially vertical direction to a second position in proximal side-by-side relation to said second lave receiving unit with said elongate openings of the units in substantially aligned communicating relationship and so that the wrapper then is disposed between said first and second lace receiving units, means for transferring the flattened shoelace convolutions from said first channel, through said elongate openings into said second channel so that the wrapper is wrapped partially around the flattened convolutions and comprising a plunger positioned and movably mounted within said first channel and extending longitudinally thereof and serving to define a channel wall movable transversely within the channel, means for then moving at least one of said lace receiving units away from the other lace receiving unit to provide therebetween a space for accommodating a folding operation, folding means movable into the space between said receiving units for folding opposite ends of the wrapper into overlapping relation against the corresponding side of the shoelace convolutions, and means for removing the thus wrapped shoelace convolutions from said second lace receiving unit and comprising a plunger positioned and movably mounted within said second elongate channel and extending longitudinally thereof and serving to define a channel wall movable transversely within the channel.

2. Apparatus according to claim 1 including normally inactive spaced apart retaining elements adjacent said second lace receiving unit and being adapted to be moved between said first and second lace receiving units following the transfer of the shoelace convolutions into said second channel for forcibly engaging the convolutions adjacent opposite side edges of the wrapper to aid in retaining the convolutions in said second channel during the folding operation, and said folding means being operable to engage and fold the opposite ends of the wrapper between said retaining elements.

3. Apparatus according to claim 1 including guide means adjacent the path of movement of said first lace receiving unit and being arranged so as to close said elongate opening in said first lace receiving unit to aid in maintaining the shoelace convolutions in said first lace receiving unit during movement thereof from its first position to its said second position.

4. Apparatus according to claim 1 including means supporting a supply of wrapper material in offset relation from said lace receiving units, and means for successively cutting lengths from the wrapper material to form successive wrappers therefrom, said means for positioning a wrapper to extend across a medial portion of the opening in said second lace receiving unit comprising wrapper gripping means adapted to grip and suspend therefrom each successive wrapper being formed by said cutting means, and means for moving said gripping means above and adjacent the opening in said second lace receiving unit for suspendingly supporting each successive formed wrapper so that it extends across the medial portion of said last-named opening.

5. Apparatus according to claim 4 wherein said gripping means comprises an arm having suction ports therein adapted to be positioned adjacent said cutting means for attracting thereto each successive wrapper being formed, a source of suction connected to said arm for producing suction in said ports, and control means for interrupting the suction in said ports during the transferring of the convolutions from said first channel into said second channel by said transferring means.

6. In an apparatus for packaging shoelaces having winding means for winding shoelaces into circular convolutions and means for flattening and thereby elongating the convolutions while moving the same away from the winding means; the combination therewith of a first lace receiving unit comprising a pair of opposing walls defining a first elongate lace confining channel therebetween and normally occupying a first position for receiving and confining therein the flattened elongate shoelace convolutions from the winding means, and said opposing walls having corresponding free longitudinal edges defining a first elongate opening therebetween communicating with said first channel, a second lace receiving unit spaced away from said first lace receiving unit in its first position and also comprising a pair of opposing walls defining therebetween a second elongate lace confining channel, and said last-named opposing walls also having corresponding free longitudinal edges defining a second elongate opening therebetween communicating with said second channel, first and second elongate plungers positioned and movably mounted within said respective channels and extending longitudinally thereof and serving to define channel walls movable transversely within the respective channels between retracted and extended positions, wherein said plungers, when retracted, occupy respective primary positions for accommodating flattened shoelace convolutions in the respective channels, and wherein, when extended, said plungers occupy respective secondary positions substantially flush with said free edges of the walls of the respective lace receiving units, and said first plunger being adapted to occupy its respective primary position when said first lace receiving unit is in said first position thereof, means for positioning a wrapper to extend across a medial portion of said opening communicating with said second channel, reciprocating means for moving said first lace receiving unit and said first plunger to a second position in proximal side-by-side relation to said second lace receiving unit with said elongate openings of the units in substantially aligned communicating relationship and so that the wrapper then is disposed between said first and second lace receiving units, said second plunger being adapted to occupy said secondary position thereof for guidingly receiving thereagainst one side of the flattened shoelace convolutions then in said first channel as said first lace receiving unit is being moved into said second position thereof, means for then moving said first plunger to its said secondary position for transferring the flattened shoelace convolutions from said first channel, through said elongate openings into said second channel to thereby move said second plunger to its said primary position and whereby the wrapper will be partially wrapped around the flattened shoelace convolutions thus transferred, means for then moving at least one of said lace receiving units away from the other lace receiving unit to provide therebetween a space for accommodating a folding operation, folding means movable into the space between said lace receiving units for folding opposite ends of the wrapper into overlapping relation against the corresponding side of the shoelace convolutions, and means for removing the thus wrapped convolutions from said second channel.

7. Apparatus according to claim 6 wherein said folding means comprises a pair of opposing folders successively movable momentarily against respective opposite ends of the wrapper for folding such ends into overlapping relation against the shoelace convolutions in said second lace receiving unit, and means operatively associated with said second plunger for imparting thereto a momentary relatively short stroke toward its said secondary position in said second channel so as to press the shoelace convolutions against the overlapping ends of the wrapper, to in turn, firmly press the ends of the wrapper against the corresponding folder.

8. Apparatus according to claim 6 adapted for use with a wrapper of heat-sealable material and wherein said folding means comprises first and second opposing folders successively movable momentarily against respective opposite ends of the wrapper for folding the ends into overlapping relation against the corresponding side of the shoelace convolutions in said second lace receiving unit, and wherein means are provided for heating said second folder, and means operatively associated with said second plunger for imparting thereto a momentary relatively short stroke toward its said secondary position in said second channel so as to press the shoelace convolutions against the overlapping ends of the wrapper, to in turn, firmly press the ends of the wrapper against the second folder to aid in heat-sealing the overlapping ends of the wrapper together.

9. Apparatus according to claim 6 including normally inactive spaced apart retaining elements adjacent said second lace receiving unit and being adapted to be moved between said first and second lace receiving units following the transfer of the shoelace convolutions into said second channel for forcibly engaging the convolutions adjacent opposite side edges of the wrapper to aid in retaining the convolutions in said second channel during the folding operation, and said folding means being operable to engage and fold the opposite ends of the wrapper between said retaining elements.

10. Apparatus according to claim 6 including means supporting a supply of wrapper material in offset relation from said lace receiving units, and means for successively cutting lengths from the wrapper material to form successive wrappers therefrom, said means for positioning a wrapper to extend across a medial portion of the opening in said second lace receiving unit comprising wrapper gripping means adapted to grip each successive wrapper being formed by said cutting means, and means for moving said gripping means adjacent the opening in said second lace receiving unit for supporting each successive formed wrapper so that it extends across the medial portion of said last-named opening.

11. Apparatus according to claim 10 wherein said gripping means comprises an arm having suction ports therein adapted to be positioned adjacent said cutting means for attracting thereto each successive wrapper being formed, a source of suction connected to said arm for producing suction in said ports, and control means for interrupting the suction in said ports during the transferring of the convolutions from said first channel into said second channel by said transferring means.

12. In an apparatus for packaging shoelaces having winding means for winding shoelaces into circular convolutions and means for flattening and thereby elongating the convolutions while moving the same away from the winding means; the combination therewith of a first lace receiving unit defining a first elongate lace confining channel extending substantially horizontally therein and normally occupying a first position for receiving and confining therein the flattened shoelace convolutions from the winding means, and said first lace receiving unit having an elongate opening in one side thereof communicating with said first channel, a second lace receiving unit spaced above said first lace receiving unit in its first position and defining a second elongate lace confining channel extending substantially horizontally therein, said second lace receiving unit also having an elongate opening in one side thereof communicating with said second channel, means for suspendingly positioning a wrapper to extend across a medial portion of said opening in said second lace receiving unit, reciprocating means for moving said first lace receiving unit upwardly to a second position in proximal side-by-side relation to said second lace receiving unit with said elongate openings of the units in substantially aligned communicating relationship and so that the wrapper then is disposed between said first and second lace receiving units, means for transferring the flattened shoelace convolutions from said first channel, through said elongate openings into said second channel so that the wrapper is wrapped partially around the flattened shoelace convolutions and comprising a plunger positioned and movably mounted within said first channel and extending longitudinally thereof and serving to define a channel wall movable transversely within the channel, a pair of laterally spaced substantially upright retaining elements movable between proximal portions of said first and second lace receiving units for forcibly engaging the corresponding side of the convolutions adjacent opposite side edges of the wrapper to aid in retaining the convolutions in said second lace receiving unit, means for moving at least one of said proximal lace receiving units away from the other lace receiving unit to provide therebetween a space for accommodating a folding operation, folding means cooperating with said spaced retaining elements and movable into the space between said lace receiving units for folding opposite ends of the wrapper into overlapping relation against the corresponding side of the convolutions and between said spaced retaining elements, a plunger positioned and movably mounted within said second elongate channel and extending longitudinally thereof and serving to define a channel wall movable transversely within said second elongate channel, and means for effecting relative movement between said second lace receiving unit and said plunger to cause said plunger to eject the thus wrapped shoelace convolutions outwardly from said second channel through said elongate opening in said second lace receiving unit.

* * * * *

UNITED STATES PATENT AND TRADEMARK OFFICE

CERTIFICATE OF CORRECTION

PATENT NO. : 4,194,340

DATED : March 25, 1980

INVENTOR(S) : Newman McIntyre

It is certified that error appears in the above-identified patent and that said Letters Patent are hereby corrected as shown below:

Page 1, in list of U. S. Patent Documents, Line 5, "7/1957" should be --7/1959--
Column 1, Line 55, "space" should be --spaced--.
Column 5, Line 31, "reciprocating" should be --reciprocatory--.
Column 7, Line 50, "afore-mentioned" should be --aforementioned--.
Column 9, Line 64, "tht" should be --that--.
Column 10, Line 52, "FIG." should be --FIGS.--.
Column 11, Line 63, "beig" should be --being--.
Column 13, CLAIM 1, Line 39, "lave" should be --lace--.

Signed and Sealed this

*Twenty-fourth* Day of *June 1980*

[SEAL]

*Attest:*

SIDNEY A. DIAMOND

*Attesting Officer*

*Commissioner of Patents and Trademarks*